US012188104B2

(12) United States Patent
Park

(10) Patent No.: US 12,188,104 B2
(45) Date of Patent: Jan. 7, 2025

(54) STEEL SHEET FOR A STRUCTURE WITH EXCELLENT SEAWATER CORROSION RESISTANCE AND METHOD OF MANUFACTURING SAME

(71) Applicant: POSCO, Pohang-si (KR)

(72) Inventor: Jin-Ho Park, Pohang-si (KR)

(73) Assignee: POSCO, Pohang-si (KR)

( * ) Notice: Subject to any disclaimer, the term of this patent is extended or adjusted under 35 U.S.C. 154(b) by 409 days.

(21) Appl. No.: 17/782,913

(22) PCT Filed: Nov. 27, 2020

(86) PCT No.: PCT/KR2020/017131
§ 371 (c)(1),
(2) Date: Jun. 6, 2022

(87) PCT Pub. No.: WO2021/118128
PCT Pub. Date: Jun. 17, 2021

(65) Prior Publication Data

US 2023/0026116 A1 Jan. 26, 2023

(30) Foreign Application Priority Data

Dec. 9, 2019 (KR) ..... 10-2019-0163090

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |

(52) U.S. Cl.
CPC ..... *C21D 9/46* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/42* (2013.01); *C22C 38/50* (2013.01); *C21D 2211/002* (2013.01); *C21D 2211/005* (2013.01); *C21D 2211/009* (2013.01)

(58) Field of Classification Search
CPC ..... C21D 9/46; C21D 8/0226; C21D 8/0263; C21D 2211/002; C21D 2211/005; C21D 2211/009; C21D 1/02; C21D 8/0205; C21D 8/0273; C22C 38/002; C22C 38/02; C22C 38/04; C22C 38/06; C22C 38/42; C22C 38/50
See application file for complete search history.

(56) References Cited

U.S. PATENT DOCUMENTS

| | | | |
|---|---|---|---|
| 2013/0233453 | A1 | 9/2013 | Kawamura et al. |
| 2018/0105907 | A1 | 4/2018 | Ota et al. |
| 2018/0371588 | A1 | 12/2018 | Jang et al. |
| 2019/0316218 | A1 | 10/2019 | Jung |

FOREIGN PATENT DOCUMENTS

| | | | |
|---|---|---|---|
| JP | 2000-273576 | A | 10/2000 |
| JP | 2002-155315 | A | 5/2002 |
| JP | 2007-277616 | A | 10/2007 |
| JP | 2008-31540 | A | 2/2008 |
| JP | 2013-256689 | A | 12/2013 |
| JP | 2017-043787 | A | 3/2017 |
| KR | 10-2004-0054272 | A | 6/2004 |
| KR | 10-2007-0099482 | A | 10/2007 |
| KR | 10-2009-0098775 | A | 9/2009 |
| KR | 10-2010-0030070 | A | 3/2010 |
| KR | 10-2011-0065949 | A | 6/2011 |
| KR | 10-1289154 | B1 | 7/2013 |
| KR | 10-2013-0139184 | A | 12/2013 |
| KR | 10-2017-0075933 | A | 7/2017 |
| KR | 10-2017-0128570 | A | 11/2017 |
| KR | 10-2018-0072500 | A | 6/2018 |
| KR | 10-2019-0034947 | A | 4/2019 |
| WO | 2018/117497 | A1 | 6/2018 |

OTHER PUBLICATIONS

Chinese Office Action dated Feb. 1, 2023 issued in Chinese Patent Application No. 202080084477.6 (with English translation).
Search Report issued Sep. 28, 2023 for counterpart European Patent Application No. 20898250.4.
International Search Report dated Apr. 13, 2021 issued in International Patent Application No. PCT/KR2020/017131 (with English translation).
Japanese Office Action dated Jul. 11, 2023 issued in Japanese Patent Application No. 2022-535152.

*Primary Examiner* — Adil A. Siddiqui
(74) *Attorney, Agent, or Firm* — Morgan, Lewis & Bockius LLP

(57) ABSTRACT

The present invention related to a structural steel sheet having excellent seawater resistance and having excellent corrosion resistance in environments in which corrosion is accelerated by seawater, and a method for manufacturing same.

7 Claims, No Drawings

STEEL SHEET FOR A STRUCTURE WITH EXCELLENT SEAWATER CORROSION RESISTANCE AND METHOD OF MANUFACTURING SAME

CROSS-REFERENCE OF RELATED APPLICATIONS

This application is the U.S. National Phase under 35 U.S.C. § 371 of International Patent Application No. PCT/KR2020/017131, filed on Nov. 27, 2020, which in turn claims the benefit of Korean Application No. 10-2019-0163090, filed on Dec. 9, 2019, the entire disclosures of which applications are incorporated by reference herein.

TECHNICAL FIELD

The present disclosure relates to a steel sheet for a structure having excellent corrosion resistance in an environment in which corrosion is accelerated by seawater, such as a steel sheet for building structures on the coast, a ballast tank in a ship and related appurtenant equipment, or the like, and a method of manufacturing the steel sheet.

BACKGROUND ART

In general, corrosion of a metal is promoted when there are many inorganic substances in the form of ions dissolved easily in water, such as salt. In particular, in the case of ions having a property of promoting corrosion, such as chlorine ions ($Cl^-$), significantly rapid corrosion may occur. Therefore, a metal containing an average of 3.5% NaCl corrodes in a seawater environment at a significantly high rate, so that corrosion is problematic under various conditions such as a structure adjacent to seawater and a ship sailing in a seawater environment, and the like.

Accordingly, a corrosion inhibition technology using various types of anti-corrosion treatment has been proposed. However, since a term of such an anti-corrosion treatment is only 20 to 30 years, maintenance costs may be continuously incurred unless corrosion resistance of a material itself is secured. That is, in order to increase durability of a structure to a long period of 50 years or more and reduce various anti-corrosion costs during a management period of the structure, it is necessary to strengthen the corrosion resistance of the material itself.

Among elements improving seawater resistance of a steel material, chromium (Cr) and copper (Cu) are the most effective elements. Chromium and copper may play different roles depending on corrosive environments, and may exhibit an excellent anti-corrosion effect even in an environment, in which corrosion is accelerated by seawater, when added in an appropriate ratio. However, chromium does not have a significant effect in an acidic environment, and copper causes casting cracking to occur in a casting process, so that relatively expensive nickel should be added to a certain level or more. However, in most environments other than a strongly acidic environment, chromium has an effect of improving corrosion resistance, and the minimum amount of nickel added to prevent casting defects of copper-added steel may be reduced due to the recent development in continuous casting technology. Accordingly, the amount of expensive nickel added may be reduced, so that the cost of a product may be reduced.

In addition, as an element having a close relationship with seawater resistance, there is manganese (Mn). When the content of manganese in steel increases, the current density value of oxidation reaction during oxidation-reduction reaction occurring in corrosion tends to increases, and as a result, the corrosion rate of steel tends to increase. Therefore, manganese tends to deteriorate seawater resistance.

Meanwhile, as the related art concerning a steel material having excellent resistance to seawater, Patent Documents 1, 2, and 3 have been proposed. Patent Document 1 discloses that a composition system and manufacturing conditions are controlled to control a microstructure of a steel sheet. However, it is difficult to secure strength when the content of a low-temperature structure is low to less than 20%, and the content of nickel (Ni) is specified as being 0.05% or less, so that many casting defects may occur during casting.

In the case of Patent Document 2, 0.1% or more of Al is added to form coarse oxide inclusions in a steelmaking process, and inclusions are crushed and elongated during a rolling process to form elongated inclusions. Accordingly, void formation is promoted to reduce localized corrosion resistance.

In addition, when tungsten (W) is added as in the case of Patent Document 3, there are a risk of continuous casting defects and a risk of galvanic corrosion caused by formation of coarse precipitates. In addition, there is a risk that a structure may be coarsened by air cooling to decrease strength.

Therefore, it may be difficult to internally secure corrosion resistance to seawater and strength in steel sheets for structure according to Patent Documents 1 to 3.

(Patent Document 1) Korean Patent Publication No. 10-2011-0076148

(Patent Document 2) Korean Patent Publication No. 10-2011-0065949

(Patent Document 3) Korean Patent Publication No. 10-2004-0054272

DISCLOSURE

Technical Problem

An aspect of the present disclosure is to provide a steel sheet having excellent corrosion resistance in an environment in which corrosion is accelerated by seawater and a method of manufacturing the same.

On the other hand, the technical problem of the present disclosure is not limited to the above description. It will be understood by those skilled in the art that there would be no difficulty in understanding additional technical problems of the present disclosure.

Technical Solution

According to an aspect of the present disclosure, a steel sheet for a structure comprises, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities, a microstructure of an entire steel sheet is 20% or more of bainite, less than 80% of polygonal ferrite and acicular ferrite in total, and 15% or less of pearlite and MA as the other phases, by area fraction, and variations of tensile strength between both end portions of the steel sheet in length direction are 50 MPa or less.

In addition, according to an aspect of the present disclosure, a method of manufacturing a steel sheet for a structure, the method comprising:

reheating a slab to a temperature of 1000° C. or more to 1200° C. or less, the slab comprising, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities;

hot rolling the reheated slab within a finish rolling temperature of 750° C. or more to 950° C. or less to obtain a steel sheet; and cooling a rolled steel sheet from a cooling start temperature of 750° C. or more to a cooling finish temperature of 400° C. or more to 700° C. or less, wherein cooling is started at an initial cooling rate of 7° C./s or more in a front end portion of a feeding steel sheet, and the cooling rate is gradually increased from a front end portion of the feeding steel sheet toward a rear end portion thereof, during the cooling.

Advantageous Effects

As set forth above, according to an example embodiment, a steel sheet (or steel plate) for a structure having excellent corrosion resistance and strength properties in seawater atmosphere may be provided.

BEST MODE FOR INVENTION

Hereinafter, example embodiments of the present disclosure will be described below. Example embodiments of the present disclosure may be modified in various forms, and the scope of the present disclosure should not be construed as being limited to the embodiments described below. These embodiments are provided to complete the present disclosure and to allow those skilled in the art to understand the scope of the disclosure.

The present inventors have conducted deep research into a method of improving corrosion resistance of a steel sheet (or steel plate) for a structure itself. As a result, the inventors have found that when the contents of chromium, copper and so on is appropriately controlled and manufacturing conditions such as a reheating temperature, a finish rolling temperature, a cooling end temperature, cooling rate and the like, are optimized to control a microstructure, excellent seawater-resistant characteristics and strength characteristic may be secured. Based on this knowledge, the inventors have invented the present invention.

In addition, during the process of slab reheating-hot rolling-cooling for manufacturing the steel sheet for a structure, in the cooling process, as the rolled steel sheet is fed, the front end portion of the steel sheet, where the cooling starts first, starts cooling at a higher temperature than the rear end portion of the steel sheet. Meanwhile, the present inventors have studied deeply to provide a steel sheet with better properties. As a results, in the steel sheet having a high phase transformation temperature (Ar3), which is the temperature at which the microstructure changes from austenite to ferrite, the microstructure between the front end portion and the rear end portion regarding the steel sheet differed greatly during the cooling process, and this results in a strength deviation.

That is, in the steel sheet for a structure manufactured by the prior art, variations in properties of material, in particular, such as yield strength (and/or tensile strength) between both end portions of the steel sheet in length direction occurred. Accordingly, the steel sheet for a structure according to the prior art could not secure sufficient lifespan characteristics in a seawater resistant atmosphere.

Therefore, the present inventors have researched reductions in the material deviation between the front end portion and the rear end portion regarding steel sheet. As a result, it was found that the material variation in the steel sheet as the final product was reduced by gradually increasing the cooling rate from the front end portion of the feeding steel sheet toward the rear end portion thereof, with the aim of weak cooling at the front end and strong cooling at the rear end, and the present invention was completed. Hereinafter, a high-strength steel sheet for a structure according to an example embodiment will be described in detail.

According to an aspect of the present disclosure, a steel sheet for a structure comprising, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities, a microstructure of an entire steel sheet is 20% or more of bainite, less than 80% of polygonal ferrite and acicular ferrite in total, and 10% or less of pearlite and MA as the other phases, by area fraction, and variations of tensile strength between both end portions of the steel sheet in a length direction are 50 MPa or less.

That is, according to the present invention, excellent strength properties could be secured by optimizing the corrosion characteristics regarding the surface of steel sheet and microstructure of the steel sheet through the optimization of the component system and manufacturing conditions. At the same time, excellent seawater resistance and corrosion resistance could be secured by minimizing the corrosion rate between both end portions in the length direction of the steel sheet.

To be specific, the present invention is technique for minimizing material deviation for a structure between both end portions in the length direction of the steel sheet. According to an aspect of the present invention, the corrosion resistance of the steel sheet itself could be improved in a seawater atmosphere, and the steel sheet could have a yield strength of 400 MPa or more and a tensile strength of 500 MPa or more. At the same time, it is possible to effectively provide a steel sheet for a structure having uniform strength characteristics in which the strength variation between both end proportions in the length direction is 50 MPa or less, and a method of manufacturing the same.

Hereinafter, the reason for adding each alloy element composing the steel composition and an appropriate content range thereof, which is one of the main features of the present invention, will be described preferentially.

Carbon (C): 0.03% or More to Less than 0.1%

Carbon (C) is an element added to improve strength. When a content of carbon (C) is increased, hardenability may be increased to improve strength. However, as the added amount of carbon is increased, general corrosion resistance is reduced. In addition, since precipitation of carbide or the like is promoted, localized corrosion resistance is also affected. The content of carbon (C) should be decreased to improve general corrosion resistance and localized corrosion resistance. However, when the content of carbon (C) is less than 0.03%, it is difficult to secure sufficient strength as a material for a steel for a structure. When the content of carbon (C) is less than 0.03%, it is difficult to secure sufficient strength as a structural material. However, when the content of carbon (C) is 0.1% or more, weldability is deteriorated to be inappropriate for the steel fora structure. Therefore, the content of carbon (C) may be limited to 0.03% or more to less than 0.1%.

Meanwhile, from the viewpoint of securing strength, the content of carbon (C) may be 0.035% or more. In some cases, the content of carbon (C) may be 0.038% or more. From the viewpoint of corrosion resistance, the content of carbon (C) may be less than 0.09%. In some cases, the content of carbon (C) may be less than 0.08% to further prevent casting cracking and to reduce carbon equivalent.

Silicon (Si): 0.1% or More to Less than 0.8%

Silicon (Si) needs to be present in amount of 0.1% or more to serve as a deoxidizer and to serve to increase strength of steel. In addition, since silicon (Si) contributes to improvements in general corrosion resistance, it is advantageous to increase the content of silicon (Si). However, when the content of silicon (Si) is 0.8% or more, toughness and weldability may be deteriorated and it may be difficult to detach scale during rolling, so that the scale may cause surface defects. Therefore, the content of silicon (Si) may be limited to, in detail, 0.1% or more to less than 0.8%. In some cases, in order to improve corrosion resistance, silicon (Si) is added in an amount of 0.2% or more, more desirably 0.25% or more. Moreover, in order to improve toughness and weldability, the content of silicon (Si) may be 0.7% or less, more desirably 0.5% or less.

Manganese (Mn): 0.3% or More to Less than 1.5%

Manganese (Mn) is an element effect in increasing the strength through solid-solution strengthening without reducing toughness. However, when an excessive amount of manganese (Mn) is added, an electrochemical reaction rate of a steel surface may be increased during a corrosion reaction to reduce corrosion resistance. When manganese (Mn) is added in an amount of less than 0.3%, it may be difficult to secure durability of a steel sheet for a structure. On the other hand, when the content of manganese (Mn) is increased, hardenability may be increased to improve strength. However, when manganese (Mn) is added in an amount of 1.5% or more, a segregation zone may be significantly developed in a central portion of thickness during slab casting in a steelmaking process, weldability may be reduced, and corrosion resistance of a surface of a steel sheet may be reduced. Therefore, the content of manganese (Mn) may be limited to, in detail, 0.3% or more to less than 1.5%. Meanwhile, from the viewpoint of securing durability, the content of manganese (Mn) may be 0.35% or more, more desirably 0.4% or more. In addition, from the viewpoint of securing corrosion resistance, the content of manganese (Mn) may be 1.4% or less, more desirably 1.2% or less.

Chromium (Cr): 0.5% or More to Less than 1.5%

Chromium (Cr) is an element increasing corrosion resistance by forming a chrome-containing oxide layer on a surface of the steel in a corrosive environment. Chromium (Cr) should be contained in an amount of 0.5% or more to sufficiently exhibit a corrosion resistance effect depending on addition of chromium (Cr). However, when chromium (Cr) is excessively contained in an amount of 1.5% or more, toughness and weldability are adversely affected. Therefore, the content of chromium (Cr) may be set to be 0.5% or more to less than 1.5%. Meanwhile, from the viewpoint of securing corrosion resistance, the content of chromium (Cr) may be 0.7% or more, more desirably 0.8% or more. In addition, from the viewpoint of securing toughness and weldability, the content of chromium (Cr) may be 1.4% or less, more desirably 1.1% or less.

Copper (Cu): 0.1% or More to Less than 0.5%

When copper (Cu) is contained in an amount of 0.1% or more together with nickel (Ni), elution of iron (Fe) is delayed, which is effective in improving general corrosion resistance and localized corrosion resistance. However, when the content of copper (Cu) is 0.5% or more, copper (Cu) in a liquid phase melts into a grain boundary during production of a slab. Thus, cracking occurs during hot working ("hot shortness"). Therefore, the content of copper (Cu) may be limited to 0.1% or more to less than 0.5%. In addition, since surface cracking, occurring during production of the slab, interacts with the contents of carbon (C), nickel (Ni), and manganese (Mn), a frequency of occurrence of the surface cracking may vary depending on the content of each element. However, the content of copper (Cu) may be set to be less than 0.45% and, in yet further detail, 0.43% or less to significantly reduce the possibility of surface cracking occurring, irrespective of the content of each element. In addition, a lower limit of the content of copper (Cu) may be, in detail, 0.2% or more and, in further detail, 0.3% or more.

Aluminum (Al): 0.01% or More to Less than 0.08%

Aluminum (Al) is an element added for deoxidation, and reacts with nitrogen (N) in the steel in such a manner that an aluminum nitride (AlN) is formed and austenite grains are refined to improve toughness. The content of aluminum (Al) in a dissolved state may be, in detail, 0.01% or more for sufficient deoxidation. On the other hand, when the aluminum (Al) is excessively included in an amount of 0.08% or more, a stretched inclusion, crushed and elongated during rolling, may be formed in a steel making process according to aluminum oxide-based characteristics. Since the formation of such an elongated inclusion promotes formation of a void around the inclusion and such a void may serve as an initiation point of localized corrosion, and the elongated inclusion serves to reduce the localized corrosion resistance. Therefore, the content of aluminum (Al) may be limited to, in detail, 0.01% or more to less than 0.08%. Meanwhile, from the viewpoint of securing sufficient deoxidation, the content of aluminum (Al) may be 0.02% or more, in further detail, 0.023% or more. In addition, from the viewpoint of securing corrosion resistance, the content of aluminum (Al) may be 0.07% or less, in further detail, 0.06% or less.

Titanium (Ti): 0.005% or More to Less than 0.1%

Titanium (Ti) is bonded to carbon (C) in steel to form TiC when added in an amount of 0.005% or more, serving to improve strength due to a precipitation strengthening effect. On the other hand, when the content of Ti is added in an amount of 0.1% or more, a strength improvement effect is not large, as compared with the increase in the content thereof. Accordingly, the content of titanium (Ti) may be limited to 0.005% or more to less than 0.1%. Meanwhile, from the viewpoint of securing sufficient strength, an upper limit of the content of titanium (Ti) may be 0.08%, more desirably 0.05%, most desirably 0.03%. In addition, a lower limit of the content of titanium (Ti) may be 0.008%, more desirably 0.01%, most desirably 0.02%.

Nickel (Ni): 0.05% or More to Less than 0.1%

Similarly to the case of copper (Cu), when nickel (Ni) is contained in an amount of 0.05% or more, it is effective in improving general corrosion resistance and localized corrosion resistance. In addition, when nickel (Ni) is added together with copper (Cu), nickel (Ni) reacts with copper (Cu) in such a manner that formation of a copper (Cu) phase having a low melting point is suppressed to prevent hot shortness from occurring. In most Cu-added steels, nickel (Ni) is generally added at one or more times of the content of copper (Cu). However, as in the present disclosure, when the content of an element related to carbon equivalent, such as carbon (C) or manganese (Mn), is low and the content of chromium (Cr) is high, shortness may be sufficiently prevented even nickel (Ni) is added in an amount less than half of the content of copper (Cu). In addition, since nickel (Ni) is an expensive element, an upper limit of the content of nickel (Ni) may be limited to, in detail, 0.1% in consideration of a relative addition effect. Meanwhile, the upper limit of the content of nickel (Ni) may be, in further detail, 0.09%. And, the lower limit of the content of nickel (Ni) may be, in further detail, 0.06% or more.

Phosphorus (P): 0.03% or Less

Phosphorus (P) is present as an impurity element in steel. When phosphorous (P) is added in an amount greater than 0.03%, weldability is significantly reduced and toughness is deteriorated. Therefore, the content of phosphorous (P) is limited to, in detail, 0.03% or less. Since phosphorous (P) is an impurity, it is advantageous as the content of phosphorous (P) is reduced. Therefore, a lower limit of the content of phosphorous (P) is not separately limited. Meanwhile, from the viewpoint of securing toughness and weldability, the content of phosphorous (P) may be 0.02% or less, more desirably 0.014% or less.

Sulfur (S): 0.02% or Less

Sulfur (S) is present as an impurity in steel. When the content of sulfur (S) is greater than 0.02%, ductility, impact toughness, and weldability of steel are deteriorated. Accordingly, the content of sulfur (S) may be limited to, in detail, 0.02% or less. Sulfur (S) is apt to react with manganese (Mn) to form an elongated inclusion such as manganese sulfide (MnS). And voids, formed on both ends of the elongated inclusion, may be an initiation point of localized corrosion. Therefore, the content of sulfur (S) may be limited to, in further detail, 0.01% or less. Meanwhile, since sulfur (S) is an impurity, it is advantageous as the content of sulfur (S) is reduced. Therefore, a lower limit of the content of sulfur (S) is not separately limited. Moreover, from the viewpoint of securing ductility, toughness and weldability, the content of sulfur (S) may be 0.01% or less, more desirably 0.006% or less.

In addition to the above-described alloy elements, a balance may be iron (Fe). However, in a common manufacturing process, unintended impurities may be inevitably incorporated from raw materials or surrounding environments, so that they may not be excluded. Since these impurities are commonly known to those skilled in the art, and all contents thereof are not specifically mentioned in this specification.

According to an aspect of the present invention, a microstructure of an entire steel sheet is 20% or more of bainite, less than 80% of polygonal ferrite and acicular ferrite in total, and less than 15% of pearlite and MA as the other phases, by area fraction.

In addition, according to an aspect of the present invention, a microstructure of an entire steel sheet is 20% or more to less than 100% of bainite, more than 0% to less than 80% of polygonal ferrite and acicular ferrite in total, and less than 15% (including 0%) of pearlite and MA as the other phases, by area fraction.

In addition, according to an aspect of the present invention, a microstructure of entire steel sheet is 20% or more to 99% or less of bainite, 1% or more to less than 80% of polygonal ferrite and acicular ferrite in total, and less than 15% (including 0%) of pearlite and MA as the other phases, by area fraction.

In addition, according to an aspect of the present invention, a microstructure of entire steel sheet is 20% or more to 98% or less of bainite, 2% or more to less than 80% of polygonal ferrite and acicular ferrite in total, and less than 15% (including 0%) of pearlite and MA as the other phases, by area fraction.

According to an aspect of the present invention, thick steel strength of at least 500 MPa or more, in generally 600 MPa or more, should be secured to be used as a material of a steel for a structure. To this end, a microstructure of an entire steel sheet according to the present invention was composed of 20% or more of bainite, less than 80% of polygonal ferrite and acicular ferrite in total. In addition, there is a possibility that low-temperature toughness and corrosion resistance are insufficient in an environment which the steel sheet for a structure according to the present invention used when pearlite and MA as the other phases is included 15% or more. Therefore, the upper limit of the area fraction of pearlite and MA as the other phases may be less than 15%.

According to an aspect of the present invention, the steel sheet for a structure may satisfy the above-mentioned composition system and microstructure to have yield strength of 400 MPa or more and/or tensile strength of 500 MPa or more.

According to an aspect of the present invention, variations of yield strength between both end portions of the steel sheet for a structure in length direction may be 50 MPa or less. In addition, according to another aspect of the present invention, variations of tensile strength between both end portions of the steel sheet for a structure in length direction may be 50 MPa or less. Or, the variations of yield strength between both end portions may be more desirably 45 MPa or less, and most desirably 41 MPa or less. Or, the variations of tensile strength between both end portions may be more desirably 40 MPa or less, and most desirably 37 MPa or less. However, the lower limit of the variations of yield strength between both end portions may not be specially limited, since it is preferable that the variations of yield strength and tensile strength between both end portions is smaller.

Meanwhile, in the present specification, the length direction coincides with the rolling direction of the steel sheet during the manufacturing process of the steel sheet, and coincides with the moving direction of the steel sheet during cooling.

In addition, according to an aspect of the present invention, when an entire length of steel sheet is defined as L, one side of both end portions of the steel sheet means a region from 0 point to ⅓L point, and the other side of both end portions of the steel sheet is a region from a ⅔L point to an L point.

That is, as described above, the present invention is a technique which can dramatically reduce material variations between both end portions in the length direction of steel sheet through gradient cooling in the manufacturing process of the steel sheet. Therefore, it is possible to effectively obtain the steel sheet in which variations of yield strength (and/or tensile strength) between both end portions is less than 50 MPa, according to the present invention.

According to the present invention, by using a steel sheet having small material variations between both end portions as a structural steel, excellent corrosion resistance especially in a seawater-resistance atmosphere, and thus, sufficient lifespan in seawater-resistance atmosphere could be secured.

Meanwhile, according to an aspect of the present invention, one side of both end portions of the steel sheet has a microstructure of, 20% or more to less than 100% of bainite, more than 0% to less than 80% of polygonal ferrite and acicular ferrite in total, and less than 15% (including 0%) of pearlite and MA as the other phases, by area fraction. The other side of both end portions of the steel sheet has a microstructure of, 20% or more to less than 100% of bainite, more than 0% to less than 80% of polygonal ferrite and acicular ferrite in total, and less than 15% (including 0%) of pearlite and MA as the other phases, by area fraction.

Moreover, according to an aspect of the present invention, one side of both end portions of the steel sheet has a microstructure of, 70% or more to 98% or less of bainite, 2% or more to 30% or less of polygonal ferrite and acicular ferrite in total, and less than 15% (including 0%) of pearlite and MA as the other phases, by area fraction. The other side of both end portions of the steel sheet has a microstructure of, 20% or more to less than 70% of bainite, 31% or more to less than 80% of polygonal ferrite and acicular ferrite in total, and less than 15% (including 0%) of pearlite and MA as the other phases, by area fraction.

Meanwhile, according to an aspect of the present invention, one side of both end portions of the steel sheet has a microstructure of, 74% or more to 81% or less of bainite, 9% or more to 15% or less of polygonal ferrite and acicular ferrite in total, and less than 15% (including 0%) of pearlite and MA as the other phases, by area fraction. The other side of both end portions of the steel sheet has a microstructure of, 20% or more to 67% or less of bainite, 31% or more to 41% or less of polygonal ferrite and acicular ferrite in total, and less than 15% (including 0%) of pearlite and MA as the other phases, by area fraction.

According to an aspect of the present invention, one side of both end portions of the steel sheet has a microstructure has bainite: 74% or more to 81% or less, polygonal ferrite and acicular ferrite: 9% or more to 15% or less, pearlite and MA as the other phases: 4% or more to 14% or less, by area fraction. The other side of both end portions of the steel sheet has a a microstructure has bainite: 57% or more to 67% or less, polygonal ferrite and acicular ferrite: 31% or more to 41% or less, pearlite and MA as the other phases: 2% or more to 6% or less, by area fraction.

In addition, according to an aspect of the present invention, when an entire length of a steel sheet is defined as L, the middle portion, except for both end portions of the steel sheet, means a region from ⅓L point to ⅔L point. The middle portion of the steel sheet has a microstructure of, 20% or more to less than 100% of bainite, more than 0% to less than 80% of polygonal ferrite and acicular ferrite in total, and less than 15% (including 0%) of pearlite and MA as the other phases, by area fraction.

In addition, according to an aspect of the present invention, when an entire length of steel sheet is defined as L, the middle portion, except for the both end portions of the steel sheet, means a region from ⅓L point to ⅔L point. The middle portion of the steel sheet has a microstructure of, 20% or more to 98% or less of bainite, 2% or more to less than 80% of polygonal ferrite and acicular ferrite in total, and less than 15% (including 0%) of pearlite and MA as the other phases, by area fraction.

Meanwhile, an aspect of the present invention provides a method of manufacturing a steel sheet for a structure, the method comprising:

reheating a slab to a temperature of 1000° C. or more to 1200° C. or less, the slab comprising, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities;

hot rolling the reheated slab within a finish rolling temperature of 750° C. or more to 950° C. or less to obtain a rolled steel sheet; and cooling the rolled steel sheet from a cooling start temperature of 750° C. or more to a cooling finish temperature of 400° C. or more to 700° C. or less, wherein cooling is started at an initial cooling rate of 7° C./s or more in a front end portion of a feeding steel sheet, and the cooling rate is gradually increased from a front end portion of the feeding steel sheet toward a rear end portion thereof, during the cooling.

Hereinafter, the method of manufacturing a steel sheet for a structure will be described. That is, the steel sheet for a structure according to the present invention will be manufactured through a slab reheating process, a hot rolling process, and a cooling process. Detailed conditions of each of the processes are as follows.

Reheating of Slab

A slab having the above-mentioned composition system is prepared, and then heated within a temperature range of 1000° C. to 1200° C. The reheating temperature may be set to 1000° C. or more to solid-solubilize carbonitride formed during casting. The reheating temperature may be set to, in further detail, 1050° C. or more to fully solid-solubilize the carbonitride. On the other hand, when the slab is reheated at significantly high temperature, austenite may be formed to be coarse. Therefore, the reheating temperature may be, in detail, 1200° C. or less.

Hot Rolling

A hot rolling process, including rough rolling and finish rolling, may be performed on the reheated slab. In this case, the rough rolling may be performed under conditions commonly known in the art and the finish rolling may be completed, in detail, at 750° C. or more of finish rolling temperature. When the finish rolling temperature is less than 750° C., a large amount of coarse air-cooled ferrite may be generated, which may cause a problem in which strength decreases. On the other hand, when the finish rolling temperature is more than 950 C, strength and toughness may be reduced due to structure coarseness. Therefore, the finish rolling temperature may be limited to, in detail, 750° C. to 950° C.

Cooling

The rolled steel sheet may be cooled from a cooling start temperature of 750° C. or more to a cooling finish temperature of 400° C. or more to 700° C. or less. In this case, the cooling may be started at an initial cooling rate of 7° C./s or more in a front end portion of a feeding steel sheet.

To be specific, the rolled steel sheet in the present invention may be for example cooled through water cooling. That is, in the present invention, a core technology is to secure high strength of even a thick steel plate through sufficient cooling. It is necessary to start a cooling process from a cooling start temperature of 750° C. or more. In addition, it is necessary to perform the cooling process at an initial cooling rate of 7° C./s or more to a cooling finish temperature of 700° C. or less (in other words, a cooling finish temperature of 400° C. or more to 700° C. or less) in order to prevent microstructure coarsening. However, in the cooling process, when the hot-rolled steel sheet is cooled to a temperature of less than 400° C., micro-cracking may occur in a central portion due to a quenching process to cause variation of material properties in a surface and a central portion of a product and a variation of material properties in front/end portions of the product. Therefore, the cooling process may be finished at temperature of, in detail, 400° C. or more.

In the cooling process, the lower limit of the cooling start temperature (the cooling start temperature at front end portion of the feeding steel sheet) may be, in detail, 820° C. and the upper limit of the cooling start temperature may be in detail, 855° C. In addition, in the cooling process, the lower limit of the cooling finish temperature may be, in detail, 578° C. and the upper limit of the cooling finish temperature may be, in detail, 625° C.

Meanwhile, the upper limit of the cooling rate may be mainly related to the capacity of the equipment. In general, depending on the plate thickness, at a cooling rate above a certain level, there is no significant change in strength even if the cooling rate is further increased. Therefore, the upper limit of the cooling rate may not be specifically limited.

Moreover, according to an aspect of the present invention, the initial cooling rate (in other words, the cooling start temperature at front end portion of steel sheet in a feeding direction of the steel sheet) may be, in detail, 10° C./s or more, or, in further detail, 80° C./s or less. By setting the initial cooling rate to 10° C./s or more, there is an effect of obtaining a microstructure and sufficient material properties through appropriate controlled cooling. By setting the initial cooling rate to 80° C./s or less, there is an effect of preventing safety accidents in operation due to overcooling and consequent plate deformation. However, more preferably, the lower limit of the initial cooling rate may be 20° C./s, and the upper limit of the initial cooling rate may be 70° C./s.

Meanwhile, according to an aspect of the present invention, the cooling time is not particularly limited, but may be performed in a range of 5 seconds (s) or more to 40 seconds (s) or less.

In addition, according to an aspect of the present invention, the thickness of the steel sheet obtained after cooling may be 5 mm or more to less than 70 mm.

Meanwhile, the cooling is characterized in that the cooling rate is gradually increased from a front end portion of the feeding steel sheet toward a rear end portion thereof.

That is, in the method of manufacturing a steel sheet according to the prior art, a difference occurs in the degree of cooling between the front end portion and the rear end portion as the steel sheet is fed in the cooling process. As a result, there was a problem resulting in that material variation between the front end portion and the rear end portion of the steel sheet. Accordingly, the present inventors have studied diligently to reduce the material variation between the front end portion and the rear end portion of the steel sheet, the cooling rate is gradually increased from the front end portion toward the rear end portion of the feeding steel sheet, with the aim of weak cooling at the front end portion and strong cooling at the rear end portion. Through this, it could be possible to effectively obtain a steel sheet for a structure having a small variation in tensile strength and/or yield strength between both end portions in the length direction.

Therefore, by gradually increasing the cooling rate from the front end portion toward the rear end portion of the feeding steel sheet as described above, the cooling rate at the rear end portion of the feeding steel sheet during cooling becomes greater than the cooling rate at the front end portion thereof.

In addition, according to an aspect of the present invention, during the cooling, gradient cooling (or accelerated cooling) could be applied in which the cooling rate may be gradually increased from the front end portion to the rear end portion in accordance with feeding the steel sheet in a gradient (Δ° C./s) of the cooling rate of 0.5° C./s or more to less than 10° C./s.

To be specific, according to an aspect of the present invention, the gradient of the cooling rate of 0.5° C./s or more to less than 10° C./s means that the cooling rate is gradually increased from the front end portion to the rear end portion so that the difference in the cooling rate measured at 1 second intervals is in the range of 0.5° C./s or more to less than 10° C./s, when the cooling rate is measured at 1 second intervals for the feeding steel sheet using the initial cooling rate (for example, 7° C./s) as the starting point.

According to an aspect of the present invention, the cooling rate may be a value of the cooling rate measured at the point at intervals of 1 second, when a point is marked on the steel sheet to be fed and the steel sheet is fed.

Meanwhile, according to an aspect of the present invention, the above-mentioned difference in the cooling rate measured at 1 second intervals only needs to be in the range of 0.5° C./s or more to less than 10° C./s. There is no need to be same value for the difference in cooling rate measured at 1 second intervals in all ranges of the feeding steel sheet.

However, according to an aspect of the present invention, the above-mentioned difference in the cooling rate measured at 1 second intervals may be, in detail, 0.5° C./s or more to less than 10° C./s, and the difference in the cooling rate measured at 1 second intervals may be the same.

For example, in the gradient cooling, the case where the gradient of the cooling rate is 0.5° C./s and the difference in the cooling rate measured at 1 intervals is same means that the cooling rate gradually increases to 10.5° C./s, 11° C./s, 11.5° C./s, 12° C./s, 12.5° C./s and so on in the feeding direction of steel sheet, when assuming that the initial cooling rate is 10° C./s.

Meanwhile, according to an aspect of the present invention, by setting the gradient of the cooling rate to 0.5° C./s or more, the microstructure of the front end portion and the rear end portion thereby the desired strength difference in the present invention could be obtained through appropriate gradient cooling. By setting the gradient of the cooling rate to less than 10° C./s, the degree of cooling of the rear end could be appropriately controlled to maintain the plate shape, and the process could be performed safely.

However, in order to achieve the desired effect of the present invention, the gradient (Δ° C./s) of the cooling rate may be, in detail, 3° C./s to 6° C./s (in other words, 3° C./s or more to 6° C./s or less).

The front end portion corresponds to one side of both end portions of the steel sheet described above, and the rear end portion corresponds to the other side of both end portions of the steel sheet described above. Therefore, the description with regard to the one side of both end portions and the other side of both end portions may be equally applicable to the front end portion and the rear end portion respectively.

Accordingly, the above-mentioned cooling start temperature means the initial temperature of cooling at the front end portion. The initial temperature of cooling at the front end portion means the temperature at a point of 0 (in other words, the temperature of which cooling starts at the front end portion in the rolling direction of the steel sheet), when an entire length of steel sheet is defined as L. Moreover, the above-mentioned cooling start temperature at the rear end portion means the temperature at a point of ⅔L (in other words, the temperature of which cooling starts at the rear end portion in the rolling direction of the steel sheet), when an entire length of steel sheet is defined as L. In this case, the entire length of steel sheet L may be at least 10 m or more.

According to an aspect of the present invention, the lower limit of the cooling start temperature at the rear end portion may be 760° C., or may be, in further detail, 790° C. Moreover, the upper limit of the cooling start temperature at the rear end portion may be 850° C., or may be, in further detail, 835° C. In addition, the cooling start temperature at the rear end portion may be 10° C. (more preferably, 15° C.) or lower than the cooling start temperature at the front end portion.

In addition, according to an aspect of the present invention, a feeding speed of the steel sheet may be 1 m/s or more to less than 10 m/s, during the cooling. On the other hand, if the feeding speed of the steel sheet during cooling is increased, the difference in the cooling start temperature between the front end portion and the rear end portion could be reduced. Thus, it is desirable to set the feeding speed of the steel sheet to 1 m/s or more, during the cooling. Moreover, in order to secure an appropriate cooling rate and reduce cooling facilities, it is desirable to set the feeding speed of the steel sheet to be less than 10 m/s, during the cooling. Meanwhile, the lower limit of the feeding speed of the steel sheet during the cooling may be, in detail, 3 m/s. And, the upper limit of the feeding speed of the steel sheet during the cooling may be, in detail, 8 m/s.

Mode for Invention

Hereinafter, embodiments of the present disclosure will be described more specifically through examples. However, the examples are for clearly explaining the embodiments of the present disclosure and are not intended to limit the scope of the present disclosure.

Example

A slab was produced by preparing molten steel having a composition system listed in Table 1 below and then performing a continuous casting process. The produced slab was reheated, hot-rolled, and cooled with gradient cooling under manufacturing conditions of Table 2 below to manufacture a steel plate. In addition, the initial cooling rate at the front end portion of the steel sheet, the gradient of the cooling rate, and the feeding speed of the steel sheet were represented in Table 3 below, with regard to the steel sheet. In addition, the gradient (Δ° C./s) of the cooling rate described in Tale 3 below represented the case where the difference in cooling rate measured at intervals of 1 second was same. Moreover, the gradient of the cooling rate represented a value for the difference in the cooling rate measured at the point at intervals of 1 second, when a point is marked on the steel sheet to be fed and the steel sheet is fed. Also, the steel sheet was fed for 5 to 10 seconds at the feeding speed shown in Table 3 during the cooling.

TABLE 1

| No. | C | Si | Mn | P | S | Sol. Al | Cu | Ni | Cr | Ti |
|---|---|---|---|---|---|---|---|---|---|---|
| IS 1 | 0.044 | 0.31 | 0.7 | 0.011 | 0.006 | 0.023 | 0.43 | 0.08 | 1.0 | 0.023 |
| IS 2 | 0.038 | 0.41 | 0.9 | 0.011 | 0.005 | 0.028 | 0.41 | 0.09 | 0.9 | 0.025 |
| IS 3 | 0.042 | 0.25 | 0.4 | 0.013 | 0.004 | 0.029 | 0.32 | 0.09 | 0.8 | 0.022 |
| IS 4 | 0.047 | 0.31 | 1.2 | 0.014 | 0.006 | 0.029 | 0.39 | 0.08 | 1.1 | 0.024 |
| CS 1 | 0.047 | 0.31 | 1.2 | 0.014 | 0.006 | 0.029 | 0.39 | 0.08 | 1.1 | 0.024 |
| CS 2 | 0.071 | 0.23 | 2.1 | 0.008 | 0.006 | 0.031 | 0.08 | 0.05 | 0.3 | 0.018 |
| CS 3 | 0.061 | 0.23 | 2.5 | 0.009 | 0.006 | 0.025 | 0.06 | 0.09 | 0.6 | 0.021 |

IS: Inventive Steel
CS: Comparative Steel

TABLE 2

| No. | Reheating Temperature (° C.) | Finishing Rolling Temperature (° C.) | Cooling Start Temperature at the front end portion (° C.) | Cooling Start Temperature at the rear end portion (° C.) | Cooling Finish Temperature (° C.) |
|---|---|---|---|---|---|
| IS 1 | 1176 | 941 | 848 | 812 | 588 |
| IS 2 | 1168 | 942 | 823 | 799 | 625 |
| IS 3 | 1181 | 952 | 851 | 834 | 578 |
| IS 4 | 1176 | 945 | 855 | 812 | 589 |
| CS 1 | 1178 | 923 | 832 | 821 | 567 |
| CS 2 | 1135 | 867 | 794 | 741 | 575 |
| CS 3 | 1131 | 856 | 779 | 724 | 604 |

IS: Inventive Steel
CS: Comparative Steel

TABLE 3

| No. | initial cooling rate (° C.) | Gradient of the cooling rate (Δ° C./s) | Feeding speed of the steel sheet (m/s) |
|---|---|---|---|
| IS 1 | 27 | 3 | 6 |
| IS 2 | 20 | 6 | 5 |
| IS 3 | 28 | 5 | 8 |
| IS 4 | 24 | 4 | 7 |
| CS 1 | 37 | 0 | 2 |
| CS 2 | 19 | 0 | 2 |
| CS 3 | 16 | 0 | 2 |

IS: Inventive Steel
CS: Comparative Steel

Meanwhile, specimens were obtained from the front end portion and the rear end portion regarding the feeding direction of the steel sheet (i.e., corresponding to both end portions in the length direction) respectively. The microstructure was observed with an optical and electron microscope, and the area fraction of each phase was measured and shown in Table 4 below. In addition, each property and material variation of the front end portion and the rear end portion regarding the feeding direction of the steel sheet (i.e., corresponding to both end portions in the length direction) were calculated and shown in Table 5 below.

Moreover, as an evaluation of seawater resistance, after immersion in a 3.5% NaCl solution simulating seawater for one day, the specimens were washed by putting it in an ultrasonic cleaner with 50% HCl+0.1% Hexamethylene tetramine solution. After measuring the weight loss, the corrosion rates were calculated by dividing this by the initial surface area of the specimens. In order to compare the corrosion rates of the comparative steels and the inventive steels, the relative corrosion rates were evaluated based on the corrosion rate of Comparative Steel 2 as 100, and the results were shown in Table 5.

TABLE 4

| | area fraction of a microstructure at the front end portion of the steel sheet (%) | | | area fraction of a microstructure at the rear end portion of the steel sheet (%) | | |
|---|---|---|---|---|---|---|
| No. | bainite | polygonal ferrite + acicular ferrite | the other phases (pearlite, MA) | bainite | polygonal ferrite + acicular ferrite | the other phases (pearlite, MA) |
| IS 1 | 81 | 15 | 4 | 67 | 31 | 2 |
| IS 2 | 79 | 9 | 12 | 59 | 37 | 4 |
| IS 3 | 74 | 12 | 14 | 62 | 32 | 6 |
| IS 4 | 81 | 11 | 8 | 57 | 41 | 2 |
| CS 1 | 92 | 4 | 5 | 28 | 59 | 13 |
| CS 2 | 24 | 63 | 3 | 2 | 89 | 8 |
| CS 3 | 32 | 52 | 16 | 0 | 74 | 26 |

IS: Inventive Steel
CS: Comparative Steel

TABLE 5

| No. | Yield Strength of the front end portion of the steel sheet (MPa) | Yield Strength of the rear end portion of the steel sheet (MPa) | variations of yield strength (MPa) | Tensile Strength of the front end portion of the steel sheet (MPa) | Tensile Strength of the rear end portion of the steel sheet (MPa) | variations of tensile strength (MPa) | The relateive corrosion rate |
|---|---|---|---|---|---|---|---|
| IS 1 | 501 | 481 | 20 | 605 | 583 | 22 | 71 |
| IS 2 | 514 | 499 | 15 | 598 | 561 | 37 | 66 |
| IS 3 | 512 | 477 | 35 | 608 | 579 | 29 | 72 |
| IS 4 | 509 | 468 | 41 | 612 | 577 | 35 | 69 |
| CS 1 | 548 | 421 | 127 | 667 | 512 | 155 | 69 |
| CS 2 | 568 | 481 | 87 | 639 | 553 | 86 | 100 |
| CS 3 | 533 | 463 | 70 | 599 | 521 | 78 | 129 |

IS: Inventive Steel
CS: Comparative Steel

As can be seen from Table 1, all of Inventive Steels 1 to 4 and Comparative Steel 1 represented the cases which satisfying the composition range specified in the present disclosure. On the other hand, Comparative Steels 2 and 3 represented the cases which does not satisfying a composition range of Cr, Cu, Ni or Mn specified in the present disclosure.

To be specific, in the cases of Inventive Steels 1 to 4 which satisfying the composition range and the manufacturing method specified in the present disclosure, in all of the front end portion and the rear end portion regarding the feeding direction of the steel sheet (corresponding to all of both end portions in the length direction), it was confirmed that the microstructures had a low-temperature structure in which bainite was 20% or more, polygonal ferrite and acicular ferrite were less than 80% in total, and pearlite and MA were 15% or less as other phases, by area fraction.

Accordingly, as shown in Table 5, in the cases of Inventive Steels 1 to 4 described above, Inventive Steels 1 to 4 exhibited sufficient properties to be used as a steel sheet for a structure by having high strengths in that yield strength of 400 MPa or more and tensile strength of 500 MPa or more, in all of the front end portion and the rear end portion regarding the feeding direction of the steel sheet. At the same time, variations of the yield strength and variations of the tensile strength between the front end portion and the rear end portion of the steel sheet were all less than 50 MPa, showing a homogeneous aspect with little material variation between the front and rear ends (or, between both end portions of the steel sheet in a length direction).

On the other hand, in the case of Comparative Steel 1, which had the alloy composition specified in the present disclosure but did not perform gradient cooling, it was confirmed that variations of the yield strength and variations of the tensile strength between the front end portion and the rear end portion of the steel sheet in the feeding direction were 50 MPa or more.

Also, in the cases of Comparative Steels 2 and 3, which did not have the alloy composition specified in the present disclosure, variations of the tensile strength between the front end portion and the rear end portion of the steel sheet in the feeding direction were all over 50 MPa.

Meanwhile, in the cases of Inventive Steels 1 to 4, in which variations of the tensile strength between the front end portion and the rear end portion were less than 50 MPa, the relative corrosion rates were low and the seawater resistances were more excellent, as compared to Comparative Steels 1 to 3. Therefore, in the case of satisfying the alloy composition and the conditions of manufacturing method prescribed in the present disclosure, it could be confirmed that sufficient lifespan in a seawater resistant atmosphere is obtained because the steel sheet has low relative corrosion rate.

The invention claimed is:

1. A steel sheet for a structure comprising, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities, a microstructure of an entire steel sheet is 20% or more of bainite, less than 80% of polygonal ferrite and acicular ferrite in total, and 15% or less of pearlite and MA as the other phases, by area fraction, and variations of tensile strength between both end portions of the steel sheet in length direction are 50 MPa or less.

2. The steel sheet for a structure of claim 1, wherein variations of yield strength between both end portions of the steel sheet in length direction are 50 MPa or less.

3. The steel sheet for a structure of claim 1, wherein one side of both end portions of the steel sheet has a microstructure of, 74% or more to 81% or less of bainite, 9% or more to 15% or less of polygonal ferrite and acicular ferrite in total, and 4% or more to 14% or less of pearlite and MA as the other phases, by area fraction, and the other side of both end portions of the steel sheet has a microstructure of, 57% or more to 67% or less of bainite, 31% or more to 41% or less of polygonal ferrite and acicular ferrite in total, and 2% or more to 6% or less of pearlite and MA as the other phases, by area fraction.

4. The steel sheet for a structure of claim 3, wherein one side of both end portions of the steel sheet is a region from 0 point to ⅓L point, when an entire length of steel sheet is L, and the other side of both end portions of the steel sheet is a region from ⅔L point to L point, when an entire length of steel sheet is L.

5. A method of manufacturing a steel sheet for a structure, the method comprising:

reheating a slab to a temperature of 1000° C. or more to 1200° C. or less, the slab comprising, by weight, carbon (C): 0.03% or more to less than 0.1%, silicon (Si): 0.1% or more to less than 0.8%, manganese (Mn): 0.3% or more to less than 1.5%, chromium (Cr): 0.5% or more to less than 1.5%, copper (Cu): 0.1% or more to less than 0.5%, aluminum (Al): 0.01% or more to less than 0.08%, titanium (Ti): 0.005% or more to less than 0.1%, nickel (Ni): 0.05% or more to less than 0.1%, phosphorus (P): 0.03% or less, sulfur (S): 0.02% or less, and a balance of iron (Fe) and unavoidable impurities;

hot rolling the reheated slab within a finish rolling temperature of 750° C. or more to 950° C. or less to obtain a rolled steel sheet; and cooling the rolled steel sheet from a cooling start temperature of 750° C. or more to a cooling finish temperature of 400° C. or more to 700° C. or less, wherein cooling is started at an initial cooling rate of 7° C./s or more in a front end portion of a transferred steel sheet, and the cooling rate is gradually increased from a front end portion of the feeding steel sheet toward a rear end portion thereof, during the cooling.

6. A method of manufacturing a steel sheet for a structure of claim 5, wherein the cooling rate is gradually increased from a front end portion of the feeding steel sheet toward a rear end portion thereof so that the gradient of the cooling rate is 0.5° C./s or more to less than 10° C./s, during the cooling.

7. A method of manufacturing a steel sheet for a structure of claim 5, wherein a feeding speed of the steel sheet is 1 m/s or more to less than 10 m/s, during the cooling.

* * * * *